US009633646B2

(12) United States Patent
Hendrix et al.

(10) Patent No.: US 9,633,646 B2
(45) **Date of Patent: *Apr. 25, 2017**

(54) OVERSIGHT CONTROL OF AN ADAPTIVE NOISE CANCELER IN A PERSONAL AUDIO DEVICE

(71) Applicant: Cirrus Logic, Inc., Austin, TX (US)

(72) Inventors: Jon D. Hendrix, Wimberly, TX (US); Ali Abdollahzadeh Milani, Austin, TX (US); Nitin Kwatra, Austin, TX (US); Dayong Zhou, Austin, TX (US); Yang Lu, Cedar Park, TX (US); Jeffrey Alderson, Austin, TX (US)

(73) Assignee: CIRRUS LOGIC, INC, Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/840,831

(22) Filed: Aug. 31, 2015

(65) Prior Publication Data

US 2016/0063988 A1 Mar. 3, 2016

Related U.S. Application Data

(63) Continuation of application No. 13/309,494, filed on Dec. 1, 2011, now Pat. No. 9,142,207.
(Continued)

(51) Int. Cl.
*G10K 11/16* (2006.01)
*G10K 11/178* (2006.01)
*H04R 1/10* (2006.01)

(52) U.S. Cl.
CPC ..... *G10K 11/1784* (2013.01); *G10K 11/1782* (2013.01); *G10K 11/1788* (2013.01);
(Continued)

(58) Field of Classification Search
CPC ..... G10K 11/1782; G10K 11/1784; G10K 11/1788; G10K 2210/108;
(Continued)

(56) References Cited

U.S. PATENT DOCUMENTS 4,020,567 A 5/1977 Webster
4,926,464 A 5/1990 Schley-May
(Continued)

FOREIGN PATENT DOCUMENTS

CN 101552939 A 10/2009
DE 102011013343 A1 9/2012
(Continued)

OTHER PUBLICATIONS

U.S. Appl. No. 15/202,644, filed Jul. 6, 2016, Hendrix, et al.
(Continued)

*Primary Examiner* — Vivian Chin
*Assistant Examiner* — Friedrich W Fahnert
(74) *Attorney, Agent, or Firm* — Mitch Harris, Atty at Law, LLC; Andrew M. Harris

(57) ABSTRACT

A personal audio device, such as a wireless telephone, includes an adaptive noise canceling (ANC) circuit that adaptively generates an anti-noise signal from a reference microphone signal and injects the anti-noise signal into the speaker or other transducer output to cause cancellation of ambient audio sounds. An error microphone is also provided proximate the speaker to measure the ambient sounds and transducer output near the transducer, thus providing an indication of the effectiveness of the noise canceling. A processing circuit uses the reference and/or error microphone, optionally along with a microphone provided for capturing near-end speech, to determine whether the ANC circuit is incorrectly adapting or may incorrectly adapt to the instant acoustic environment and/or whether the anti-noise
(Continued)

signal may be incorrect and/or disruptive and then take action in the processing circuit to prevent or remedy such conditions.

21 Claims, 6 Drawing Sheets

Related U.S. Application Data

(60) Provisional application No. 61/419,527, filed on Dec. 3, 2010, provisional application No. 61/493,162, filed on Jun. 3, 2011.

(52) U.S. Cl.
CPC ..... *H04R 1/1083* (2013.01); *G10K 2210/108* (2013.01); *G10K 2210/1081* (2013.01); *G10K 2210/3017* (2013.01); *G10K 2210/3045* (2013.01); *G10K 2210/3216* (2013.01); *G10K 2210/3226* (2013.01); *G10K 2210/504* (2013.01); *H04R 2460/01* (2013.01); *H04R 2499/11* (2013.01)

(58) Field of Classification Search
CPC ... G10K 2210/1081; G10K 2210/3017; G10K 2210/3045; G10K 2210/3216; G10K 2210/3226; G10K 2210/504; H04R 1/1083; H04R 2460/01; H04R 2499/11
USPC ..... 381/56–58, 71.2, 71.7, 71.8, 71.11, 73.1, 381/77, 79, 91, 92, 94.1–94.3, 94.9, 381/95–98, 122, 334, 345, 71.6
See application file for complete search history.

(56) References Cited

U.S. PATENT DOCUMENTS 4,998,241 A 3/1991 Brox et al.
5,018,202 A 5/1991 Takahashi
5,021,753 A 6/1991 Chapman
5,044,373 A 9/1991 Northeved et al.
5,117,401 A 5/1992 Feintuch
5,251,263 A 10/1993 Andrea et al.
5,278,913 A 1/1994 Delfosse et al.
5,321,759 A 6/1994 Yuan
5,337,365 A 8/1994 Hamabe et al.
5,359,662 A 10/1994 Yuan et al.
5,377,276 A 12/1994 Terai et al.
5,386,477 A 1/1995 Popovich et al.
5,410,605 A 4/1995 Sawada et al.
5,425,105 A 6/1995 Lo et al.
5,445,517 A 8/1995 Kondou et al.
5,465,413 A 11/1995 Enge et al.
5,481,615 A 1/1996 Eatwell et al.
5,548,681 A 8/1996 Gleaves et al.
5,550,925 A 8/1996 Hori et al.
5,559,893 A 9/1996 Krokstad et al.
5,563,819 A 10/1996 Nelson
5,586,190 A 12/1996 Trantow et al.
5,633,795 A 5/1997 Popovich
5,640,450 A 6/1997 Watanabe
5,668,747 A 9/1997 Ohashi
5,687,075 A 11/1997 Stothers
5,696,831 A 12/1997 Inanaga et al.
5,699,437 A 12/1997 Finn
5,706,344 A 1/1998 Finn
5,740,256 A 4/1998 Castello Da Costa et al.
5,768,124 A 6/1998 Stothers et al.
5,809,152 A 9/1998 Nakamura et al.
5,815,582 A 9/1998 Claybaugh et al.
5,832,095 A 11/1998 Daniels
5,852,667 A 12/1998 Pan et al.
5,909,498 A 6/1999 Smith
5,940,519 A 8/1999 Kuo
5,946,391 A 8/1999 Dragwidge et al.
5,991,418 A 11/1999 Kuo
6,041,126 A 3/2000 Terai et al.
6,118,878 A 9/2000 Jones
6,181,801 B1 1/2001 Puthuff et al.
6,185,300 B1 2/2001 Romesburg
6,219,427 B1 4/2001 Kates et al.
6,278,786 B1 8/2001 McIntosh
6,282,176 B1 8/2001 Hemkumar
6,304,179 B1 10/2001 Lolito et al.
6,317,501 B1 11/2001 Matsuo
6,418,228 B1 7/2002 Terai et al.
6,434,246 B1 8/2002 Kates et al.
6,434,247 B1 8/2002 Kates et al.
6,445,799 B1 9/2002 Taenzer et al.
6,522,746 B1 2/2003 Marchok et al.
6,542,436 B1 4/2003 Myllyla
6,650,701 B1 11/2003 Hsiang et al.
6,683,960 B1 1/2004 Fujii et al.
6,738,482 B1 5/2004 Jaber
6,766,292 B1 7/2004 Chandran
6,768,795 B2 7/2004 Feltstrom et al.
6,792,107 B2 9/2004 Tucker et al.
6,850,617 B1 2/2005 Weigand
6,940,982 B1 9/2005 Watkins
7,016,504 B1 3/2006 Shennib
7,034,614 B2 4/2006 Robinson et al.
7,058,463 B1 6/2006 Ruha et al.
7,103,188 B1 9/2006 Jones
7,110,864 B2 9/2006 Restrepo et al.
7,181,030 B2 2/2007 Rasmussen et al.
7,330,739 B2 2/2008 Somayajula
7,365,669 B1 4/2008 Melanson
7,368,918 B2 5/2008 Henson et al.
7,406,179 B2 7/2008 Ryan
7,441,173 B2 10/2008 Restrepo et al.
7,466,838 B1 12/2008 Mosely
7,555,081 B2 6/2009 Keele, Jr.
7,680,456 B2 3/2010 Muhammad et al.
7,742,746 B2 6/2010 Xiang et al.
7,742,790 B2 6/2010 Konchitsky et al.
7,817,808 B2 10/2010 Konchitsky et al.
7,953,231 B2 5/2011 Ishida
8,019,050 B2 9/2011 Mactavish et al.
8,085,966 B2 12/2011 Amsel
8,107,637 B2 1/2012 Asada et al.
8,144,888 B2 3/2012 Berkhoff et al.
8,155,334 B2 4/2012 Joho et al.
8,165,313 B2 4/2012 Carreras
D666,169 S 8/2012 Tucker et al.
8,249,262 B2 8/2012 Chua et al.
8,251,903 B2 8/2012 LeBoeuf et al.
8,254,589 B2 8/2012 Mitsuhata
8,290,537 B2 10/2012 Lee et al.
8,311,243 B2 11/2012 Tucker et al.
8,325,934 B2 12/2012 Kuo
8,331,604 B2 12/2012 Saito et al.
8,374,358 B2 2/2013 Buck et al.
8,379,884 B2 2/2013 Horibe et al.
8,401,200 B2 3/2013 Tiscareno et al.
8,401,204 B2 3/2013 Odent et al.
8,442,251 B2 5/2013 Jensen et al.
8,526,627 B2 9/2013 Asao et al.
8,526,628 B1 9/2013 Massie et al.
8,532,310 B2 9/2013 Gauger, Jr. et al.
8,539,012 B2 9/2013 Clark
8,559,661 B2 10/2013 Tanghe
8,600,085 B2 12/2013 Chen et al.
8,775,172 B2 7/2014 Konchitsky et al.
8,804,974 B1 8/2014 Melanson
8,831,239 B2 9/2014 Bakalos
8,842,848 B2 9/2014 Donaldson et al.
8,848,936 B2 9/2014 Kwatra et al.
8,855,330 B2 10/2014 Taenzer
8,907,829 B1 12/2014 Naderi
8,908,877 B2 12/2014 Abdollahzadeh Milani et al.
8,909,524 B2 12/2014 Stoltz et al.
8,942,976 B2 1/2015 Li et al.
8,948,407 B2 2/2015 Alderson et al.

(56) References Cited

U.S. PATENT DOCUMENTS 8,948,410 B2 2/2015 Van Leest
8,958,571 B2 2/2015 Kwatra et al.
8,977,545 B2 3/2015 Zeng et al.
9,020,160 B2 4/2015 Gauger, Jr.
9,066,176 B2 6/2015 Hendrix et al.
9,071,724 B2 6/2015 Do et al.
9,076,431 B2 7/2015 Kamath et al.
9,082,391 B2 7/2015 Yermeche et al.
9,129,586 B2 9/2015 Bajic et al.
9,203,366 B2 12/2015 Eastty
9,478,212 B1 10/2016 Sorensen et al.
2001/0053228 A1 12/2001 Jones
2002/0003887 A1 1/2002 Zhang et al.
2003/0063759 A1 4/2003 Brennan et al.
2003/0072439 A1 4/2003 Gupta
2003/0185403 A1 10/2003 Sibbald
2004/0017921 A1 1/2004 Mantovani
2004/0047464 A1 3/2004 Yu et al.
2004/0120535 A1 6/2004 Woods
2004/0165736 A1 8/2004 Hetherington et al.
2004/0167777 A1 8/2004 Hetherington et al.
2004/0202333 A1 10/2004 Csermak et al.
2004/0240677 A1 12/2004 Onishi et al.
2004/0242160 A1 12/2004 Ichikawa et al.
2004/0264706 A1 12/2004 Ray et al.
2005/0004796 A1 1/2005 Trump et al.
2005/0018862 A1 1/2005 Fisher
2005/0117754 A1 6/2005 Sakawaki
2005/0207585 A1 9/2005 Christoph
2005/0240401 A1 10/2005 Ebenezer
2006/0013408 A1 1/2006 Lee
2006/0018460 A1 1/2006 McCree
2006/0035593 A1 2/2006 Leeds
2006/0055910 A1 3/2006 Lee
2006/0069556 A1 3/2006 Nadjar et al.
2006/0153400 A1 7/2006 Fujita et al.
2006/0159282 A1 7/2006 Borsch
2006/0161428 A1 7/2006 Fouret
2006/0251266 A1 11/2006 Saunders et al.
2007/0030989 A1 2/2007 Kates
2007/0033029 A1 2/2007 Sakawaki
2007/0038441 A1 2/2007 Inoue et al.
2007/0047742 A1 3/2007 Taenzer et al.
2007/0053524 A1 3/2007 Haulick et al.
2007/0076896 A1 4/2007 Hosaka et al.
2007/0154031 A1 7/2007 Avendano et al.
2007/0208520 A1 9/2007 Zhang et al.
2007/0258597 A1 11/2007 Rasmussen et al.
2007/0297620 A1 12/2007 Choy
2008/0019548 A1 1/2008 Avendano
2008/0101589 A1 5/2008 Horowitz et al.
2008/0107281 A1 5/2008 Togami et al.
2008/0144853 A1 6/2008 Sommerfeldt et al.
2008/0177532 A1 7/2008 Greiss et al.
2008/0181422 A1 7/2008 Christoph
2008/0226098 A1 9/2008 Haulick et al.
2008/0240413 A1 10/2008 Mohammad et al.
2008/0240455 A1 10/2008 Inoue et al.
2008/0240457 A1 10/2008 Inoue et al.
2008/0269926 A1 10/2008 Xiang et al.
2009/0012783 A1 1/2009 Klein
2009/0034748 A1 2/2009 Sibbald
2009/0041260 A1 2/2009 Jorgensen et al.
2009/0046867 A1 2/2009 Clemow
2009/0060222 A1 3/2009 Jeong et al.
2009/0080670 A1 3/2009 Solbeck et al.
2009/0086990 A1 4/2009 Christoph
2009/0175461 A1 7/2009 Nakamura et al.
2009/0175466 A1 7/2009 Elko et al.
2009/0196429 A1 8/2009 Ramakrishnan et al.
2009/0220107 A1 9/2009 Every et al.
2009/0238369 A1 9/2009 Ramakrishnan et al.
2009/0245529 A1 10/2009 Asada et al.
2009/0254340 A1 10/2009 Sun et al.
2009/0290718 A1 11/2009 Kahn et al.
2009/0296965 A1 12/2009 Kojima
2009/0304200 A1 12/2009 Kim et al.
2009/0311979 A1 12/2009 Husted et al.
2010/0002891 A1 1/2010 Shiraishi et al.
2010/0014683 A1 1/2010 Maeda et al.
2010/0014685 A1 1/2010 Wurm
2010/0061564 A1 3/2010 Clemow et al.
2010/0069114 A1 3/2010 Lee et al.
2010/0082339 A1 4/2010 Konchitsky et al.
2010/0098263 A1 4/2010 Pan et al.
2010/0098265 A1 4/2010 Pan et al.
2010/0124335 A1 5/2010 Wessling et al.
2010/0124336 A1 5/2010 Shridhar et al.
2010/0124337 A1 5/2010 Wertz et al.
2010/0131269 A1 5/2010 Park et al.
2010/0142715 A1 6/2010 Goldstein et al.
2010/0150367 A1 6/2010 Mizuno
2010/0158330 A1 6/2010 Guissin et al.
2010/0166203 A1 7/2010 Peissig et al.
2010/0166206 A1 7/2010 Macours
2010/0195838 A1 8/2010 Bright
2010/0195844 A1 8/2010 Christoph et al.
2010/0207317 A1 8/2010 Iwami et al.
2010/0226210 A1 9/2010 Kordis et al.
2010/0239126 A1 9/2010 Grafenberg et al.
2010/0246855 A1 9/2010 Chen
2010/0260345 A1 10/2010 Shridhar et al.
2010/0266137 A1 10/2010 Sibbald et al.
2010/0272276 A1 10/2010 Carreras et al.
2010/0272283 A1 10/2010 Carreras et al.
2010/0274564 A1 10/2010 Bakalos et al.
2010/0284546 A1 11/2010 DeBrunner et al.
2010/0291891 A1 11/2010 Ridgers et al.
2010/0296666 A1 11/2010 Lin
2010/0296668 A1 11/2010 Lee et al.
2010/0310086 A1 12/2010 Magrath et al.
2010/0322430 A1 12/2010 Isberg
2011/0007907 A1 1/2011 Park et al.
2011/0026724 A1 2/2011 Doclo
2011/0091047 A1 4/2011 Konchitsky et al.
2011/0099010 A1 4/2011 Zhang
2011/0106533 A1 5/2011 Yu
2011/0116654 A1 5/2011 Chan et al.
2011/0129098 A1 6/2011 Delano et al.
2011/0130176 A1 6/2011 Magrath et al.
2011/0142247 A1 6/2011 Fellers et al.
2011/0144984 A1 6/2011 Konchitsky
2011/0158419 A1 6/2011 Theverapperuma et al.
2011/0206214 A1 8/2011 Christoph et al.
2011/0288860 A1 11/2011 Schevciw et al.
2011/0293103 A1 12/2011 Park et al.
2011/0299695 A1 12/2011 Nicholson
2011/0305347 A1 12/2011 Wurm
2011/0317848 A1 12/2011 Ivanov et al.
2012/0135787 A1 5/2012 Kusunoki et al.
2012/0140917 A1 6/2012 Nicholson et al.
2012/0140942 A1 6/2012 Loeda
2012/0140943 A1 6/2012 Hendrix et al.
2012/0148062 A1 6/2012 Scarlett et al.
2012/0155666 A1 6/2012 Nair
2012/0170766 A1 7/2012 Alves et al.
2012/0179458 A1 7/2012 Oh et al.
2012/0215519 A1 8/2012 Park et al.
2012/0250873 A1 10/2012 Bakalos et al.
2012/0259626 A1 10/2012 Li et al.
2012/0263317 A1 10/2012 Shin et al.
2012/0281850 A1 11/2012 Hyatt
2012/0300955 A1 11/2012 Iseki et al.
2012/0300958 A1 11/2012 Klemmensen
2012/0300960 A1 11/2012 Mackay et al.
2012/0308025 A1 12/2012 Hendrix et al.
2012/0308027 A1 12/2012 Kwatra
2012/0308028 A1 12/2012 Kwatra et al.
2013/0010982 A1 1/2013 Elko et al.
2013/0083939 A1 4/2013 Fellers et al.
2013/0156238 A1 6/2013 Birch et al.
2013/0195282 A1 8/2013 Ohita et al.
2013/0243198 A1 9/2013 Van Rumpt
2013/0243225 A1 9/2013 Yokota

(56) References Cited

U.S. PATENT DOCUMENTS

| | | | |
|---|---|---|---|
| 2013/0272539 | A1 | 10/2013 | Kim et al. |
| 2013/0287218 | A1 | 10/2013 | Alderson et al. |
| 2013/0287219 | A1 | 10/2013 | Hendrix et al. |
| 2013/0301842 | A1 | 11/2013 | Hendrix et al. |
| 2013/0301846 | A1 | 11/2013 | Alderson et al. |
| 2013/0301847 | A1 | 11/2013 | Alderson et al. |
| 2013/0301848 | A1 | 11/2013 | Zhou et al. |
| 2013/0301849 | A1 | 11/2013 | Alderson et al. |
| 2013/0315403 | A1 | 11/2013 | Samuelsson |
| 2013/0343556 | A1 | 12/2013 | Bright |
| 2013/0343571 | A1 | 12/2013 | Rayala et al. |
| 2014/0016803 | A1 | 1/2014 | Puskarich |
| 2014/0036127 | A1 | 2/2014 | Pong et al. |
| 2014/0044275 | A1 | 2/2014 | Goldstein et al. |
| 2014/0050332 | A1 | 2/2014 | Nielsen et al. |
| 2014/0072134 | A1 | 3/2014 | Po et al. |
| 2014/0086425 | A1 | 3/2014 | Jensen et al. |
| 2014/0146976 | A1 | 5/2014 | Rundle |
| 2014/0169579 | A1 | 6/2014 | Azmi |
| 2014/0177851 | A1 | 6/2014 | Kitazawa et al. |
| 2014/0177890 | A1 | 6/2014 | Hojlund et al. |
| 2014/0211953 | A1 | 7/2014 | Alderson et al. |
| 2014/0270222 | A1 | 9/2014 | Hendrix et al. |
| 2014/0270223 | A1 | 9/2014 | Li et al. |
| 2014/0270224 | A1 | 9/2014 | Zhou et al. |
| 2014/0294182 | A1 | 10/2014 | Axelsson et al. |
| 2014/0307887 | A1 | 10/2014 | Alderson |
| 2014/0307888 | A1 | 10/2014 | Alderson et al. |
| 2014/0307890 | A1 | 10/2014 | Zhou et al. |
| 2014/0314244 | A1 | 10/2014 | Yong |
| 2014/0314247 | A1 | 10/2014 | Zhang |
| 2014/0341388 | A1 | 11/2014 | Goldstein |
| 2014/0369517 | A1 | 12/2014 | Zhou et al. |
| 2015/0092953 | A1 | 4/2015 | Abdollahzadeh Milani et al. |
| 2015/0104032 | A1 | 4/2015 | Kwatra et al. |
| 2015/0161981 | A1 | 6/2015 | Kwatra |
| 2015/0195646 | A1 | 7/2015 | Kumar et al. |
| 2015/0256953 | A1 | 9/2015 | Kwatra et al. |
| 2015/0365761 | A1 | 12/2015 | Alderson et al. |

FOREIGN PATENT DOCUMENTS

| | | | |
|---|---|---|---|
| EP | 0412902 | A2 | 2/1991 |
| EP | 0756407 | A2 | 1/1997 |
| EP | 0898266 | A2 | 2/1999 |
| EP | 1691577 | A2 | 8/2006 |
| EP | 1880699 | A2 | 1/2008 |
| EP | 1947642 | A1 | 7/2008 |
| EP | 2133866 | A1 | 12/2009 |
| EP | 2216774 | A1 | 8/2010 |
| EP | 2237573 | A1 | 10/2010 |
| EP | 2395500 | A1 | 12/2011 |
| EP | 2395501 | A1 | 12/2011 |
| EP | 2551845 | A1 | 1/2013 |
| GB | 2401744 | A | 11/2004 |
| GB | 2436657 | A | 10/2007 |
| GB | 2455821 | A | 6/2009 |
| GB | 2455824 | A | 6/2009 |
| GB | 2455828 | A | 6/2009 |
| GB | 2484722 | A | 4/2012 |
| GB | 2539280 | A | 12/2016 |
| JP | H05265468 | | 10/1993 |
| JP | 06006246 | | 1/1994 |
| JP | H06-186985 | A | 7/1994 |
| JP | H06232755 | | 8/1994 |
| JP | 07098592 | | 4/1995 |
| JP | 07104769 | | 4/1995 |
| JP | 07240989 | | 9/1995 |
| JP | 07325588 | | 12/1995 |
| JP | H07334169 | | 12/1995 |
| JP | H08227322 | | 9/1996 |
| JP | H10247088 | | 9/1998 |
| JP | H10257159 | | 9/1998 |
| JP | H11305783 | A | 11/1999 |
| JP | 2000089770 | | 3/2000 |
| JP | 2002010355 | | 1/2002 |
| JP | 2004007107 | | 1/2004 |
| JP | 2006217542 | A | 8/2006 |
| JP | 2007060644 | | 3/2007 |
| JP | 2008015046 | A | 1/2008 |
| JP | 2010277025 | | 12/2010 |
| JP | 2011061449 | | 3/2011 |
| WO | WO 9113429 | | 9/1991 |
| WO | WO 9911045 | | 3/1999 |
| WO | WO 03015074 | A1 | 2/2003 |
| WO | WO 03015275 | A1 | 2/2003 |
| WO | WO 2004009007 | A1 | 1/2004 |
| WO | WO 2004017303 | A1 | 2/2004 |
| WO | WO 2006125061 | A1 | 11/2006 |
| WO | WO 2006128768 | A1 | 12/2006 |
| WO | WO 2007007916 | A1 | 1/2007 |
| WO | WO 2007011337 | | 1/2007 |
| WO | WO 2007110807 | A2 | 10/2007 |
| WO | WO 2007113487 | A1 | 11/2007 |
| WO | WO 2009041012 | A1 | 4/2009 |
| WO | WO 2009110087 | A1 | 9/2009 |
| WO | WO 2009155696 | A1 | 12/2009 |
| WO | WO 2010117714 | A1 | 10/2010 |
| WO | WO 2010131154 | A1 | 11/2010 |
| WO | WO 2012134874 | A1 | 10/2012 |
| WO | WO-2013106370 | A1 | 7/2013 |
| WO | WO 2015038255 | A1 | 3/2015 |
| WO | WO 2015088639 | A1 | 6/2015 |
| WO | WO 2015088651 | A1 | 6/2015 |
| WO | WO 2016054186 | A1 | 4/2016 |
| WO | WO-2016100602 | A1 | 6/2016 |

OTHER PUBLICATIONS

U.S. Appl. No. 14/832,585, filed Aug. 21, 2015, Zhou.
U.S. Appl. No. 15/241,375, filed Aug. 19, 2016, Lu, et al.
U.S. Appl. No. 13/686,353, filed Nov. 27, 2012, Hendrix, et al.
U.S. Appl. No. 13/794,931, filed Mar. 12, 2013, Lu, et al.
U.S. Appl. No. 13/794,979, filed Mar. 12, 2013, Alderson, et al.
U.S. Appl. No. 14/197,814, filed Mar. 5, 2014, Kaller, et al.
U.S. Appl. No. 14/210,537, filed Mar. 14, 2014, Abdollahzadeh Milani, et.
U.S. Appl. No. 14/210,589, filed Mar. 14, 2014, Abdollahzadeh Milani, et.
U.S. Appl. No. 13/762,504, filed Feb. 8, 2013, Abdollahzadeh Milani, et.
U.S. Appl. No. 13/721,832, filed Dec. 20, 2012, Lu, et al.
U.S. Appl. No. 13/724,656, filed Dec. 21, 2012, Lu, et al.
U.S. Appl. No. 14/252,235, filed Apr. 14, 2014, Lu, et al.
U.S. Appl. No. 13/968,013, filed Aug. 15, 2013, Abdollahzadeh Milani et.
U.S. Appl. No. 13/924,935, filed Jun. 24, 2013, Hellman.
U.S. Appl. No. 14/101,955, filed Dec. 10, 2013, Alderson.
U.S. Appl. No. 14/101,777, filed Dec. 10, 2013, Alderson et al.
U.S. Appl. No. 14/656,124, filed Mar. 12, 2015, Hendrix, et al.
U.S. Appl. No. 14/734,321, filed Jun. 9, 2015, Alderson, et al.
Pfann, et al., "LMS Adaptive Filtering with Delta-Sigma Modulated Input Signals," IEEE Signal Processing Letters, Apr. 1998, pp. 95-97, vol. 5, No. 4, IEEE Press, Piscataway, NJ.
Toochinda, et al. "A Single-Input Two-Output Feedback Formulation for ANC Problems," Proceedings of the 2001 American Control Conference, Jun. 2001, pp. 923-928, vol. 2, Arlington, VA.
Kuo, et al., "Active Noise Control: A Tutorial Review," Proceedings of the IEEE, Jun. 1999, pp. 943-973, vol. 87, No. 6, IEEE Press, Piscataway, NJ.
Johns, et al., "Continuous-Time LMS Adaptive Recursive Filters," IEEE Transactions on Circuits and Systems, Jul. 1991, pp. 769-778, vol. 38, No. 7, IEEE Press, Piscataway, NJ.
Shoval, et al., "Comparison of DC Offset Effects in Four LMS Adaptive Algorithms," IEEE Transactions on Circuits and Systems II: Analog and Digital Processing, Mar. 1995, pp. 176-185, vol. 42, Issue 3, IEEE Press, Piscataway, NJ.
Mali, Dilip, "Comparison of DC Offset Effects on LMS Algorithm and its Derivatives," International Journal of Recent Trends in Engineering, May 2009, pp. 323-328, vol. 1, No. 1, Academy Publisher.

(56) References Cited

OTHER PUBLICATIONS

Kates, James M., "Principles of Digital Dynamic Range Compression," Trends in Amplification, Spring 2005, pp. 45-76, vol. 9, No. 2, Sage Publications.
Gao, et al., "Adaptive Linearization of a Loudspeaker," IEEE International Conference on Acoustics, Speech, and Signal Processing, Apr. 14-17, 1991, pp. 3589-3592, Toronto, Ontario, CA.
Silva, et al., "Convex Combination of Adaptive Filters With Different Tracking Capabilities," IEEE International Conference on Acoustics, Speech, and Signal Processing, Apr. 15-20, 2007, pp. III 925-III 928, vol. 3, Honolulu, HI, USA.
Akhtar, et al., "A Method for Online Secondary Path Modeling in Active Noise Control Systems," IEEE International Symposium on Circuits and Systems, May 23-26, 2005, pp. 264-267, vol. 1, Kobe, Japan.
Davari, et al., "A New Online Secondary Path Modeling Method for Feedforward Active Noise Control Systems," IEEE International Conference on Industrial Technology, Apr. 21-24, 2008, pp. 1-6, Chengdu, China.
Lan, et al., "An Active Noise Control System Using Online Secondary Path Modeling With Reduced Auxiliary Noise," IEEE Signal Processing Letters, Jan. 2002, pp. 16-18, vol. 9, Issue 1, IEEE Press, Piscataway, NJ.
Liu, et al., "Analysis of Online Secondary Path Modeling With Auxiliary Noise Scaled by Residual Noise Signal," IEEE Transactions on Audio, Speech and Language Processing, Nov. 2010, pp. 1978-1993, vol. 18, Issue 8, IEEE Press, Piscataway, NJ.
Black, John W., "An Application of Side-Tone in Subjective Tests of Microphones and Headsets", Project Report No. NM 001 064.01.20, Research Report of the U.S. Naval School of Aviation Medicine, Feb. 1, 1954, 12 pages (pp. 1-12 in pdf), Pensacola, FL, US.
Peters, Robert W., "The Effect of High-Pass and Low-Pass Filtering of Side-Tone Upon Speaker Intelligibility", Project Report No. NM 001 064.01.25, Research Report of the U.S. Naval School of Aviation Medicine, Aug. 16, 1954, 13 pages (pp. 1-13 in pdf), Pensacola, FL, US.
Lane, et al., "Voice Level: Autophonic Scale, Perceived Loudness, and the Effects of Sidetone", The Journal of the Acoustical Society of America, Feb. 1961, pp. 160-167, vol. 33, No. 2., Cambridge, MA, US.
Liu, et al., "Compensatory Responses to Loudness-shifted Voice Feedback During Production of Mandarin Speech", Journal of the Acoustical Society of America, Oct. 2007, pp. 2405-2412, vol. 122, No. 4.
Paepcke, et al., "Yelling in the Hall: Using Sidetone to Address a Problem with Mobile Remote Presence Systems", Symposium on User Interface Software and Technology, Oct. 16-19, 2011, 10 pages (pp. 1-10 in pdf), Santa Barbara, CA, US.
Therrien, et al., "Sensory Attenuation of Self-Produced Feedback: The Lombard Effect Revisited", PLOS ONE, Nov. 2012, pp. 1-7, vol. 7, Issue 11, e49370, Ontario, Canada.
Abdollahzadeh Milani, et al., "On Maximum Achievable Noise Reduction in ANC Systems",2010 IEEE International Conference on Acoustics Speech and Signal Processing, Mar. 14-19, 2010, pp. 349-352, Dallas, TX, US.
Cohen, Israel, "Noise Spectrum Estimation in Adverse Environments: Improved Minima Controlled Recursive Averaging", IEEE Transactions on Speech and Audio Processing, Sep. 2003, pp. 1-11, vol. 11, Issue 5, Piscataway, NJ, US.
Ryan, et al., "Optimum Near-Field Performance of Microphone Arrays Subject to a Far-Field Beampattern Constraint", J. Acoust. Soc. Am., Nov. 2000, pp. 2248-2255, 108 (5), Pt. 1, Ottawa, Ontario, Canada.
Cohen, et al., "Noise Estimation by Minima Controlled Recursive Averaging for Robust Speech Enhancement", IEEE Signal Processing Letters, Jan. 2002, pp. 12-15, vol. 9, No. 1, Piscataway, NJ, US.
Martin, Rainer, "Noise Power Spectral Density Estimation Based on Optimal Smoothing and Minimum Statistics", IEEE Transactions on Speech and Audio Processing, Jul. 2001, pp. 504-512, vol. 9, No. 5, Piscataway, NJ, US.
Martin, Rainer, "Spectral Subtraction Based on Minimum Statistics", Signal Processing VII Theories and Applications, Proceedings of EUSIPCO-94, 7th European Signal Processing Conference, Sep. 13-16, 1994, pp. 1182-1185, vol. III, Edinburgh, Scotland, U.K.
Booij, et al., "Virtual sensors for local, three dimensional, broadband multiple-channel active noise control and the effects on the quiet zones", Proceedings of the International Conference on Noise and Vibration Engineering, ISMA 2010, Sep. 20-22, 2010, pp. 151-166, Leuven.
Kuo, et al., "Residual noise shaping technique for active noise control systems", J. Acoust. Soc. Am. 95 (3), Mar. 1994, pp. 1665-1668.
Lopez-Gaudana, Edgar Omar, "Active Noise Cancellation: The Unwanted Signal and the Hybrid Solution", Adaptive Filtering Applications, Dr. Lino Garcia (Ed.), Jul. 2011, pp. 49-84, ISBN: 978-953-307-306-4, InTech.
Senderowicz, et al., "Low-Voltage Double-Sampled Delta-Sigma Converters", IEEE Journal on Solid-State Circuits, Dec. 1997, pp. 1907-1919, vol. 32, No. 12, Piscataway, NJ.
Hurst, et al., "An improved double sampling scheme for switched-capacitor delta-sigma modulators", 1992 IEEE Int. Symp. on Circuits and Systems, May 10-13, 1992, vol. 3, pp. 1179-1182, San Diego, CA
Campbell, Mikey, "Apple looking into self-adjusting earbud headphones with noise cancellation tech", Apple Insider, Jul. 4, 2013, pp. 1-10 (10 pages in pdf), downloaded on May 14, 2014 from http://appleinsider.com/articles/13/07/04/apple-looking-into-self-adjusting-earbud-headphones-with-noise-cancellation-tech.
Jin, et al. "A simultaneous equation method-based online secondary path modeling algorithm for active noise control", Journal of Sound and Vibration, Apr. 25, 2007, pp. 455-474, vol. 303, No. 3-5, London, GB.
Erkelens, et al., "Tracking of Nonstationary Noise Based on Data-Driven Recursive Noise Power Estimation", IEEE Transactions on Audio Speech and Language Processing, Aug. 2008, pp. 1112-1123, vol. 16, No. 6, Piscataway, NJ, US.
Rao, et al., "A Novel Two State Single Channel Speech Enhancement Technique", India Conference (INDICON) 2011 Annual IEEE, IEEE, Dec. 2011, 6 pages (pp. 1-6 in pdf), Piscataway, NJ, US.
Rangachari, et al., "A noise-estimation algorithm for highly non-stationary environments", Speech Communication, Feb. 2006, pp. 220-231, vol. 48, No. 2. Elsevier Science Publishers.
Parkins, et al., "Narrowband and broadband active control in an enclosure using the acoustic energy density", J. Acoust. Soc. Am. Jul. 2000, pp. 192-203, vol. 108, issue 1, US.
Feng, Jinwei et al., "A broadband self-tuning active noise equaliser", Signal Processing, Elsevier Science Publishers B.V. Amsterdam, NL, vol. 62, No. 2, Oct. 1, 1997, pp. 251-256.
Zhang, Ming et al., "A Robust Online Secondary Path Modeling Method with Auxiliary Noise Power Scheduling Strategy and Norm Constraint Manipulation", IEEE Transactions on Speech and Audio Processing, IEEE Service Center, New York, NY, vol. 11, No. 1, Jan. 1, 2003.
Lopez-Gaudana, Edgar et al., "A hybrid active noise cancelling with secondary path modeling", 51st Midwest Symposium on Circuits and Systems, 2008, MWSCAS 2008, Aug. 10, 2008, pp. 277-280.
Widrow, B., et al., Adaptive Noice Cancelling; Principles and Applications, Proceedings of the IEEE, Dec. 1975, pp. 1692-1716, vol. 63, No. 13, IEEE, New York, NY, US.
Morgan, et al., A Delayless Subband Adaptive Filter Architecture, IEEE Transactions on Signal Processing, IEEE Service Center, Aug. 1995, pp. 1819-1829, vol. 43, No. 8, New York, NY, US.
Office Action in U.S. Appl. No. 13/309,494 mailed on Oct. 6, 2014, 40 pages (pp. 1-40 in pdf).
Notice of Allowance in U.S. Appl. No. 13/309,494 mailed on Mar. 18, 2015, 9 pages (pp. 1-9 in pdf).
Notice of Allowance in U.S. Appl. No. 13/309,494 mailed on Jun. 19, 2015, 11 pages (pp. 1-11 in pdf).

(56) References Cited

OTHER PUBLICATIONS

International Search Report and Written Opinion in PCT/US2011/062968 mailed on Jan. 15, 2013, 16 pages (pp. 1-16 in pdf).
International Preliminary Report on Patentability in PCT/US2011/062968 mailed on Jun. 13, 2013, 10 pages (pp. 1-10 in pdf).
Rafaely, Boaz, "Active Noise Reducing Headset—an Overview", The 2001 International Congress and Exhibition on Noice Control Engineering, Aug. 27-30, 2001, 10 pages. (pp. 1-10 in pdf), The Netherlands.
Ray, et al., "Hybrid Feedforward-Feedback Active Noise Reduction for Hearing Protection and Communication", The Journal of the Acoustical Society of America, American Institute of Physics for the Acoustical Society of America, Jan. 2006, pp. 2026-2036, , vol. 120, No. 4, New York, NY.
Wu, et al., "Decoupling feedforward and feedback structures in hybrid active noise control systems for uncorrelated narrowband disturbances", Journal of Sound and Vibration, vol. 350, Aug. 18, 2015, pp. 1-10, Elsevier.
Lopez-Caudana, et al., "A Hybrid Noise Cancelling Algorithm with Secondary Path Estimation", WSEAS Transactions on Signal Processing, vol. 4, No. 12, Dec. 2008, pp. 677-687, Mexico.
U.S. Appl. No. 15/070,564, filed Mar. 15, 2016, Zhou, et al.
U.S. Appl. No. 15/130,271, filed Apr. 15, 2016, Hendrix, et al.

OVERSIGHT CONTROL OF AN ADAPTIVE NOISE CANCELER IN A PERSONAL AUDIO DEVICE

This U.S. patent application is a Continuation of U.S. patent application Ser. No. 13/309,494 filed on Dec. 1, 2011 and published as U.S. Patent Publication 20120140943 on Jun. 7, 2012, and claims priority thereto under 35 U.S.C. 120. U.S. patent application Ser. No. 13/309,494 claims priority under 35 U.S.C. 119(e) to U.S. Provisional Patent Application Ser. No. 61/419,527 filed on Dec. 3, 2010 and to U.S. Provisional Patent Application Ser. No. 61/493,162 filed on Jun. 3, 2011.

BACKGROUND OF THE INVENTION

1. Field of the Invention

The present invention relates generally to personal audio devices such as wireless telephones that include adaptive noise cancellation (ANC), and more specifically, to management of ANC in a personal audio device under various operating conditions.

2. Background of the Invention

Wireless telephones, such as mobile/cellular telephones, cordless telephones, and other consumer audio devices, such as mp3 players, are in widespread use. Performance of such devices with respect to intelligibility can be improved by providing noise canceling using a microphone to measure ambient acoustic events and then using signal processing to insert an anti-noise signal into the output of the device to cancel the ambient acoustic events.

Since the acoustic environment around personal audio devices such as wireless telephones can change dramatically, depending on the sources of noise that are present and the position of the device itself, it is desirable to adapt the noise canceling to take into account such environmental changes. However, adaptive noise canceling circuits can be complex, consume additional power and can generate undesirable results under certain circumstances.

Therefore, it would be desirable to provide a personal audio device, including a wireless telephone, that provides noise cancellation in a variable acoustic environment.

SUMMARY OF THE INVENTION

The above stated objective of providing a personal audio device providing noise cancellation in a variable acoustic environment, is accomplished in a personal audio device, a method of operation, and an integrated circuit.

The personal audio device includes a housing, with a transducer mounted on the housing for reproducing an audio signal that includes both source audio for playback to a listener and an anti-noise signal for countering the effects of ambient audio sounds in an acoustic output of the transducer, which may include the integrated circuit to provide adaptive noise-canceling (ANC) functionality. The method is a method of operation of the personal audio device and integrated circuit. A reference microphone is mounted on the housing to provide a reference microphone signal indicative of the ambient audio sounds. The personal audio device further includes an ANC processing circuit within the housing for adaptively generating an anti-noise signal from the reference microphone signal using one or more adaptive filters, such that the anti-noise signal causes substantial cancellation of the ambient audio sounds. An error microphone is included for controlling the adaptation of the anti-noise signal to cancel the ambient audio sounds and for correcting for the electro-acoustic path from the output of the processing circuit through the transducer.

By analyzing the audio received from the reference and error microphone, the ANC processing circuit can be controlled in accordance with types of ambient audio that are present. Under certain circumstances, the ANC processing circuit may not be able to generate an anti-noise signal that will cause effective cancellation of the ambient audio sounds, e.g., the transducer cannot produce such a response, or the proper anti-noise cannot be determined. Certain conditions may also cause the adaptive filter(s) to exhibit chaotic or other uncontrolled behavior. The ANC processing circuit of the present invention detects such conditions and takes action on the adaptive filter(s) to reduce the impact of such events and to prevent an erroneous anti-noise signal from being generated.

The foregoing and other objectives, features, and advantages of the invention will be apparent from the following, more particular, description of the preferred embodiment of the invention, as illustrated in the accompanying drawings.

DESCRIPTION OF ILLUSTRATIVE EMBODIMENT

The present invention encompasses noise canceling techniques and circuits that can be implemented in a personal audio device, such as a wireless telephone. The personal audio device includes an adaptive noise canceling (ANC) circuit that measures the ambient acoustic environment and generates a signal that is injected in the speaker (or other transducer) output to cancel ambient acoustic events. A reference microphone is provided to measure the ambient acoustic environment and an error microphone is included for controlling the adaptation of the anti-noise signal to cancel the ambient audio sounds and for correcting for the electro-acoustic path from the output of the processing circuit through the transducer. However, under certain acoustic conditions, e.g., when a particular acoustic condition or event occurs, the ANC circuit may operate improperly or in an unstable/chaotic manner. The present invention provides mechanisms for preventing and/or minimizing the impact of such conditions.

Figure 1:
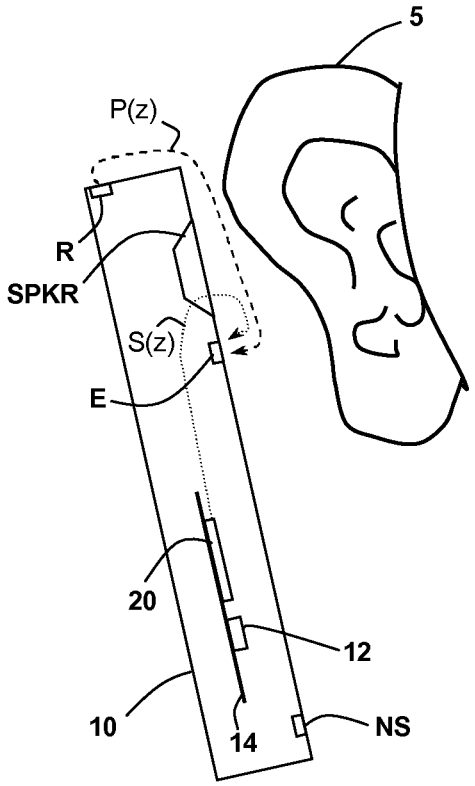
FIG. 1 is an illustration of a wireless telephone 10 in accordance with an embodiment of the present invention.

Referring now to FIG. 1, a wireless telephone 10 is illustrated in accordance with an embodiment of the present invention is shown in proximity to a human ear 5. Illustrated wireless telephone 10 is an example of a device in which techniques in accordance with embodiments of the invention may be employed, but it is understood that not all of the elements or configurations embodied in illustrated wireless telephone 10, or in the circuits depicted in subsequent illustrations, are required in order to practice the invention recited in the Claims. Wireless telephone 10 includes a transducer, such as speaker SPKR that reproduces distant speech received by wireless telephone 10, along with other local audio events such as ringtones, stored audio program material, injection of near-end speech (i.e., the speech of the user of wireless telephone 10) to provide a balanced conversational perception, and other audio that requires reproduction by wireless telephone 10, such as sources from web-pages or other network communications received by wireless telephone 10 and audio indications such as battery low and other system event notifications. A near-speech microphone NS is provided to capture near-end speech, which is transmitted from wireless telephone 10 to the other conversation participant(s).

Wireless telephone 10 includes adaptive noise canceling (ANC) circuits and features that inject an anti-noise signal into speaker SPKR to improve intelligibility of the distant speech and other audio reproduced by speaker SPKR. A reference microphone R is provided for measuring the ambient acoustic environment, and is positioned away from the typical position of a user's mouth, so that the near-end speech is minimized in the signal produced by reference microphone R. A third microphone, error microphone E, is provided in order to further improve the ANC operation by providing a measure of the ambient audio combined with the audio reproduced by speaker SPKR close to ear 5, when wireless telephone 10 is in close proximity to ear 5. Exemplary circuit 14 within wireless telephone 10 includes an audio CODEC integrated circuit 20 that receives the signals from reference microphone R, near speech microphone NS and error microphone E and interfaces with other integrated circuits such as an RF integrated circuit 12 containing the wireless telephone transceiver. In other embodiments of the invention, the circuits and techniques disclosed herein may be incorporated in a single integrated circuit that contains control circuits and other functionality for implementing the entirety of the personal audio device, such as an MP3 player-on-a-chip integrated circuit.

In general, the ANC techniques of the present invention measure ambient acoustic events (as opposed to the output of speaker SPKR and/or the near-end speech) impinging on reference microphone R, and by also measuring the same ambient acoustic events impinging on error microphone E, the ANC processing circuits of illustrated wireless telephone 10 adapt an anti-noise signal generated from the output of reference microphone R to have a characteristic that minimizes the amplitude of the ambient acoustic events at error microphone E. Since acoustic path P(z) extends from reference microphone R to error microphone E, the ANC circuits are essentially estimating acoustic path P(z) combined with removing effects of an electro-acoustic path S(z) that represents the response of the audio output circuits of CODEC IC 20 and the acoustic/electric transfer function of speaker SPKR including the coupling between speaker SPKR and error microphone E in the particular acoustic environment, which is affected by the proximity and structure of ear 5 and other physical objects and human head structures that may be in proximity to wireless telephone 10, when wireless telephone is not firmly pressed to ear 5. While the illustrated wireless telephone 10 includes a two microphone ANC system with a third near speech microphone NS, some aspects of the present invention may be practiced in a system that does not include separate error and reference microphones, or a wireless telephone uses near speech microphone NS to perform the function of the reference microphone R. Also, in personal audio devices designed only for audio playback, near speech microphone NS will generally not be included, and the near-speech signal paths in the circuits described in further detail below can be omitted, without changing the scope of the invention, other than to limit the options provided for input to the microphone covering detection schemes.

Figure 2:
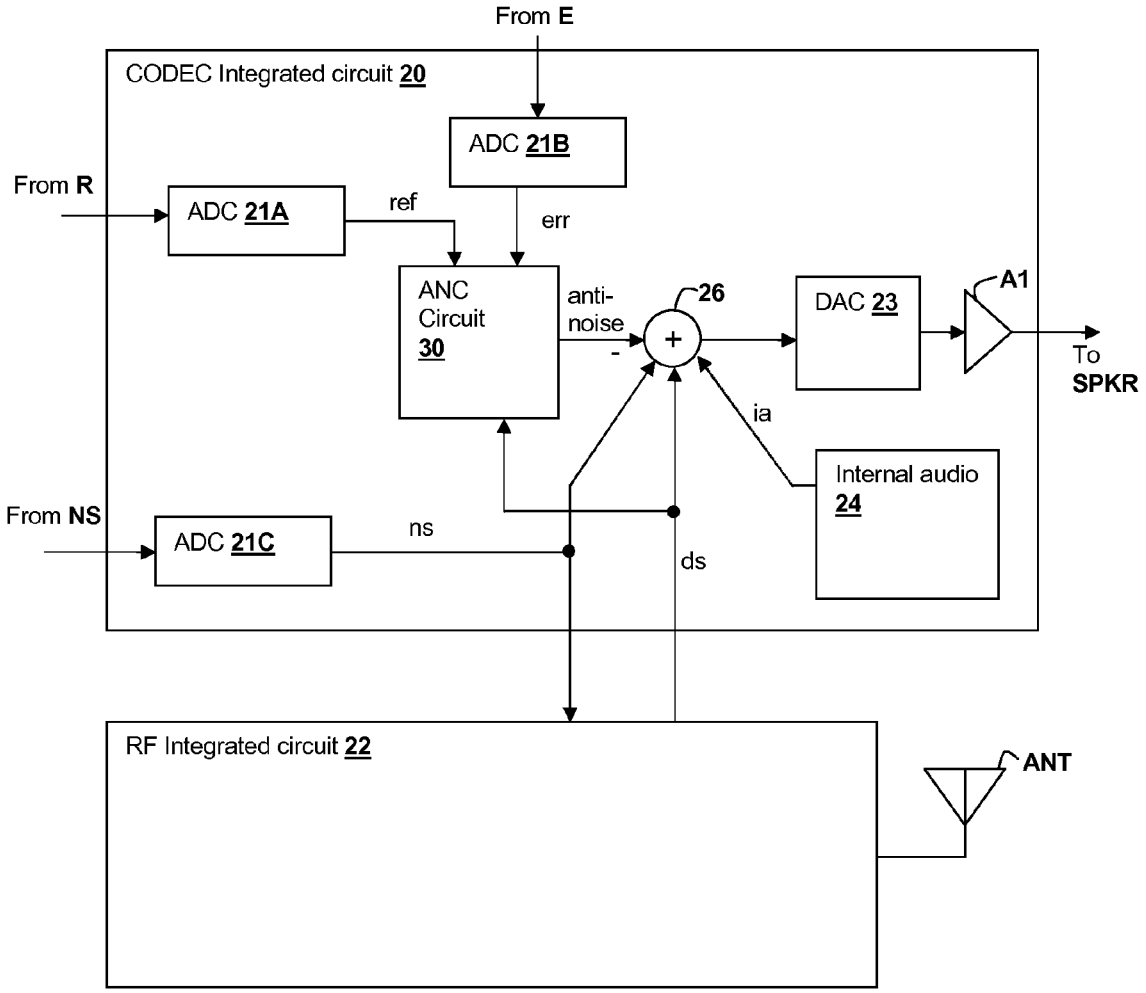
FIG. 2 is a block diagram of circuits within wireless telephone 10 in accordance with an embodiment of the present invention.

Referring now to FIG. 2, circuits within wireless telephone 10 are shown in a block diagram. CODEC integrated circuit 20 includes an analog-to-digital converter (ADC) 21A for receiving the reference microphone signal and generating a digital representation ref of the reference microphone signal, an ADC 21B for receiving the error microphone signal and generating a digital representation err of the error microphone signal, and an ADC 21C for receiving the near speech microphone signal and generating a digital representation ns of the error microphone signal. CODEC IC 20 generates an output for driving speaker SPKR from an amplifier A1, which amplifies the output of a digital-to-analog converter (DAC) 23 that receives the output of a combiner 26. Combiner 26 combines audio signals from internal audio sources 24, the anti-noise signal generated by ANC circuit 30, which by convention has the same polarity as the noise in reference microphone signal ref and is therefore subtracted by combiner 26, a portion of near speech signal ns so that the user of wireless telephone 10 hears their own voice in proper relation to downlink speech ds, which is received from radio frequency (RF) integrated circuit 22 and is also combined by combiner 26. Near speech signal ns is also provided to RF integrated circuit 22 and is transmitted as uplink speech to the service provider via antenna ANT.

Figure 3:
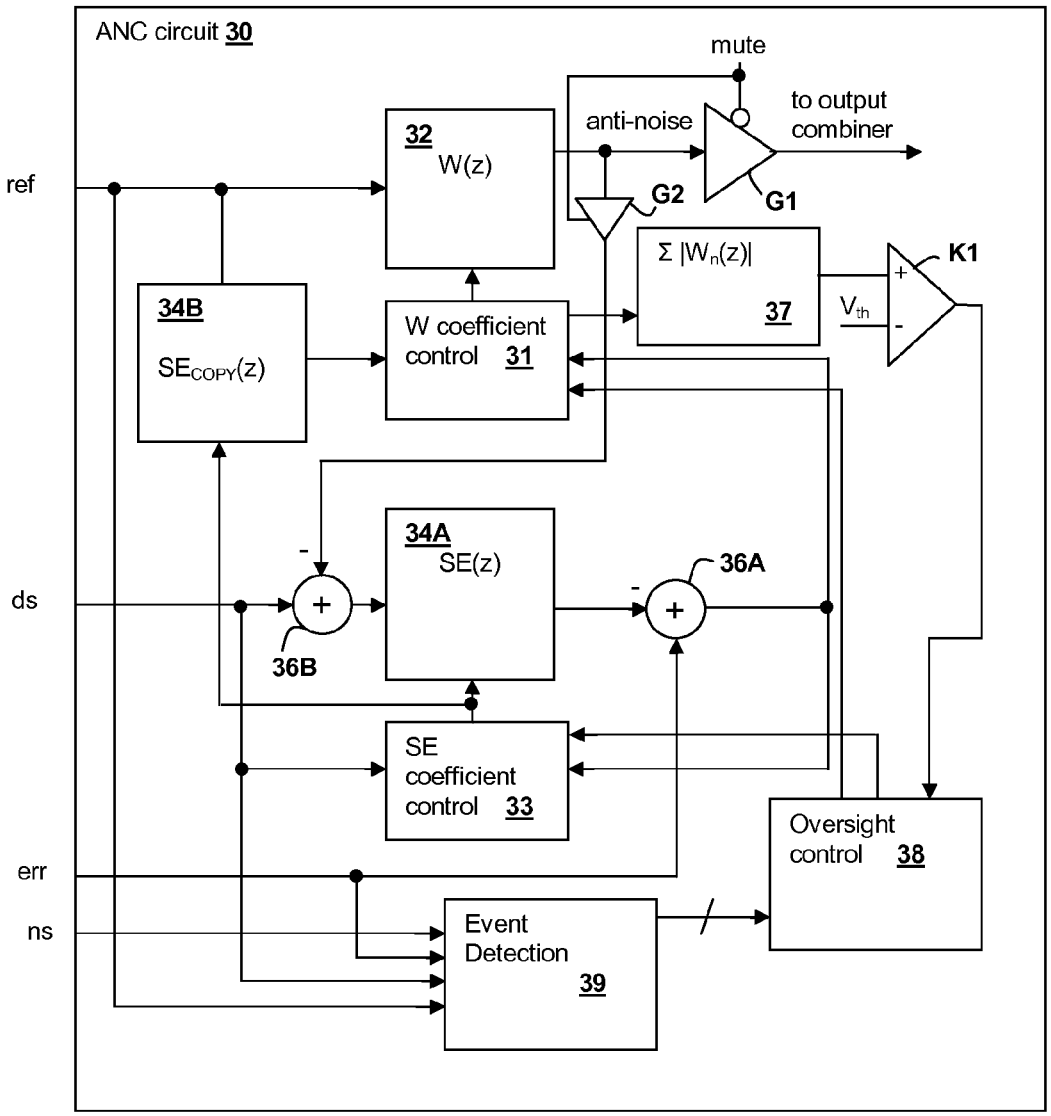
FIG. 3 is a block diagram depicting signal processing circuits and functional blocks within ANC circuit 30 of CODEC integrated circuit 20 of FIG. 2 in accordance with an embodiment of the present invention.

Referring now to FIG. 3, details of ANC circuit 30 are shown in accordance with an embodiment of the present invention. Adaptive filter 32 receives reference microphone signal ref and under ideal circumstances, adapts its transfer function W(z) to be P(z)/S(z) to generate the anti-noise signal, which is provided to an output combiner that combines the anti-noise signal with the audio to be reproduced by the transducer, as exemplified by combiner 26 of FIG. 2. A muting gate circuit G1 mutes the anti-noise signal under certain conditions as described in further detail below, when the anti-noise signal is expected to be erroneous or ineffective. In accordance with some embodiments of the invention, another gate circuit G2 controls re-direction of the anti-noise signal into a combiner 36B that provides an input signal to secondary path adaptive filter 34A, permitting W(z) to continue to adapt while the anti-noise signal is muted during certain ambient acoustic conditions as described below. The coefficients of adaptive filter 32 are controlled by a W coefficient control block 31 that uses a correlation of two signals to determine the response of adaptive filter 32, which generally minimizes the error, in a least-mean squares sense, between those components of reference microphone signal ref present in error microphone signal err. The signals compared by W coefficient control block 31 are the reference microphone signal ref as shaped by a copy of an estimate of the response of path S(z) provided by filter 34B and another signal that includes error microphone signal err. By transforming reference microphone signal ref with a copy of the estimate of the response of path S(z), $SE_{copy}(z)$, and minimizing the difference between the resultant signal and error microphone signal err, adaptive filter 32 adapts to the desired response of P(z)/S(z). In addition to error microphone signal err, the signal compared to the output of filter 34B by W coefficient control block 31 includes an inverted amount of downlink audio signal ds that has been processed by filter response SE(z), of which response $SE_{copy}(z)$ is a copy. By injecting an inverted amount of downlink audio signal ds, adaptive filter 32 is prevented from adapting to the relatively large amount of downlink audio present in error microphone signal err, and by transforming that inverted copy of downlink audio signal ds with the estimate of the response of path S(z), the downlink audio that is removed from error microphone signal err before comparison should match the expected version of downlink audio signal ds reproduced at error microphone signal err, since the electrical and acoustical path of S(z) is the path taken by downlink audio signal ds to arrive at error microphone E. Filter 34B is not an adaptive filter, per se, but has an adjustable response that is tuned to match the response of adaptive filter 34A, so that the response of filter 34B tracks the adapting of adaptive filter 34A.

To implement the above, adaptive filter 34A has coefficients controlled by SE coefficient control block 33, which compares downlink audio signal ds and error microphone signal err after removal of the above-described filtered downlink audio signal ds, that has been filtered by adaptive filter 34A to represent the expected downlink audio delivered to error microphone E, and which is removed from the output of adaptive filter 34A by a combiner 36A. SE coefficient control block 33 correlates the actual downlink speech signal ds with the components of downlink audio signal ds that are present in error microphone signal err. Adaptive filter 34A is thereby adapted to generate a signal from downlink audio signal ds (and optionally, the anti-noise signal combined by combiner 36B during muting conditions as described above), that when subtracted from error microphone signal err, contains the content of error microphone signal err that is not due to downlink audio signal ds. Event detection 39 and oversight control logic 38 perform various actions in response to various events in conformity with various embodiments of the invention, as will be disclosed in further detail below.

Table 1 below depicts a list of ambient audio events or conditions that may occur in the environment of wireless telephone 10 of FIG. 1, the issues that arise with the ANC operation, and the responses taken by the ANC processing circuits when the particular ambient events or conditions are detected.

TABLE I

| Type of Ambient Audio Condition or Event | Cause | Issue | Response |
|---|---|---|---|
| Mechanical Noise at Microphone or instability of the coefficients of W(z) in general | Wind, Scratching, etc. | Unstable anti-noise, ineffective cancelation | Mute anti-noise<br>Stop adapt W(z)<br>Reset W(z)<br>Optional 1:<br>Stop adapt SE(z)<br>Reset/Backtrack SE(z)<br>Alternative:<br>Mute anti-noise<br>Redirect anti-noise into SE(z) |
| Howling | Positive feedback caused by increased acoustic coupling between transducer and reference microphone | Anti-noise generates undesirable tone | Mute anti-noise<br>Stop adapt W(z)<br>Stop adapt SE(z)<br>Reset W(z)<br>Optional:<br>Reset/Backtrack SE(z) |
| Overloading noise | SPL too high | Clipping of signals in ANC circuit or transducer can't produce enough output to cancel | Stop adapt W(z)<br>Optionally mute anti-noise<br>Optional:<br>stop adapting SE(s)<br>reset/backtrack SE(z) |
| Silence | Quiet Environment | No reason to ANC, nothing to adapt to. | Stop adapt W(z)<br>Optionally mute anti-noise |
| Tone | Multiple | Disrupts response of W(z) | Stop adapt W(z) |
| Near-end speech | User talking | Don't want to train to cancel near end speech | Stop adapt W(z) or increase leakage |
| Source audio too low | Downlink audio silent, or playback of media stops | Insufficient level to train SE(z) | Stop adapt SE(z) |

As illustrated in FIG. 3, W coefficient control block 31 provides the coefficient information to a computation block 37 that computes the time derivative of the sum $\Sigma|W_n(z)|$ of the magnitudes of the coefficients $W_n(z)$ that shape the response of adaptive filter 32, which is an indication of the variation overall gain of the response of adaptive filter 32. Large variations in sum $\Sigma|W_n(z)|$ indicate that mechanical noise such as that produced by wind incident on reference microphone R or varying mechanical contact (e.g., scratching) on the housing of wireless telephone 10, or other conditions such as an adaptation step size that is too large and causes unstable operation has been used in the system. A comparator K1 compares the time derivative of sum $\Sigma|W_n(z)|$ to a threshold to provide an indication to oversight control 38 of a mechanical noise condition, which may be qualified with a detection by event detection 39, whether there are large changes in the energy of near-end speech signal ns that could indicate that the variation in sum $\Sigma|W_n(z)|$ is due to variation in the energy of near-end speech present at wireless telephone 10.

Figure 4:
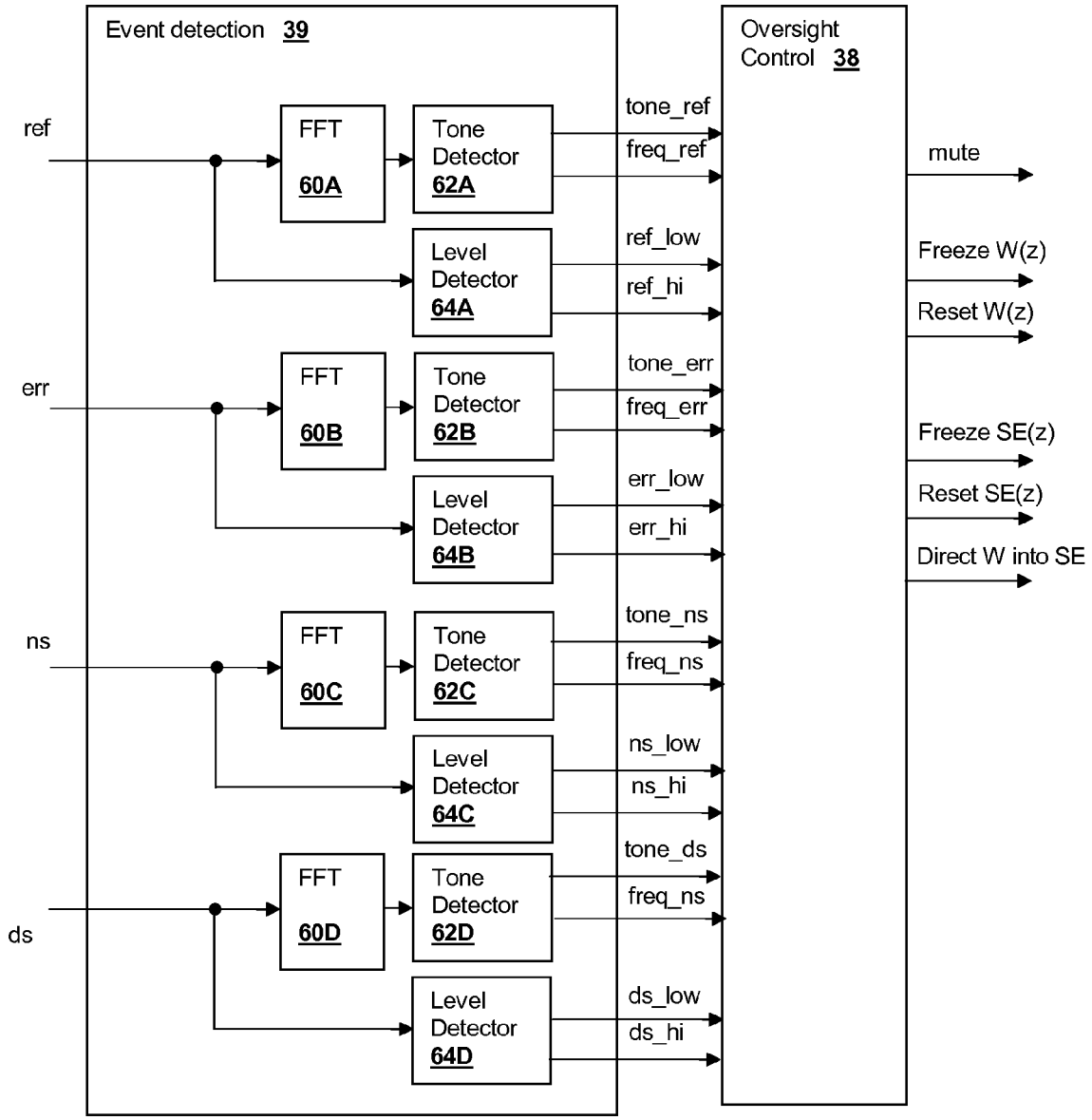
FIG. 4 is a block diagram illustrating functional blocks associated with ambient audio event detection and ANC control in the circuit of FIG. 3 in accordance with an embodiment of the present invention.

Referring now to FIG. 4, details within event detection circuit 39 of FIG. 3 are shown, in accordance with an embodiment of the present invention. Each of reference microphone signal ref, error microphone signal err, near speech signal ns, and downlink speech ds are provided to corresponding FFT processing blocks 60A-60D, respectively. Corresponding tone detectors 62A-62D receive the outputs from their corresponding FFT processing blocks 60A-60D and generate flags (tone_ref, tone_err, tone_ns and tone_ds) that indicate the presence or absence of a consistent well-defined peak in the spectrum of the input signal that indicates the presence of a tone. Tone detectors 62A-62D also provide an indication of the frequency of the detected tone (freq_ref, freq_err, freq_ns and freq_ds). Each of reference microphone signal ref, error microphone signal err, near speech signal ns, and downlink speech ds are also provided to corresponding level detectors 64A-64D, respectively, that generate an indication (ref_low, err_low, ns_low, ds_low) when the level of the corresponding input signal level drops below a predetermined lower limit and another indication (ref_hi, err_hi, ns_hi, ds_hi) when the corresponding input signal exceeds a predetermined upper limit. With the information generated by event detector 39, oversight control 38 can determine whether a strong tone is present, including howling due to positive feedback between the transducer and reference microphone ref, as may be caused by cupping a hand between the transducer and the reference microphone ref, and take appropriate action within the ANC processing circuits. Howling is detected by determining that a tone is present at each of the microphone inputs (i.e., tone_ref, tone_err and tone_ns are all set), that the frequencies of the tone are all equal (freq_ref=freq_err=freq_ns) and the levels of the bin of the fundamental bin of the tone is greater in error microphone channel err than in the reference microphone channel ref and the speech channel ns by corresponding thresholds, and that the err_freq value is not equal to ds_freq, which would indicate that the tone is coming from downlink speech ds and should be reproduced. Oversight control 38 can also distinguish other types of tones that may be present and take other actions. Oversight control 38 also monitors the reference microphone signal level indications, ref_low and ref_hi, to determine whether overloading noise is present or the ambient environment is silent, near speech level indication ns_hi, which indicates that near speech is present, and downlink audio level indication ds_low to determine whether downlink audio is absent. Each of the above-listed conditions corresponds to a row in Table I, and oversight control takes the appropriate action, as listed, when the particular condition is detected.

Figure 5:
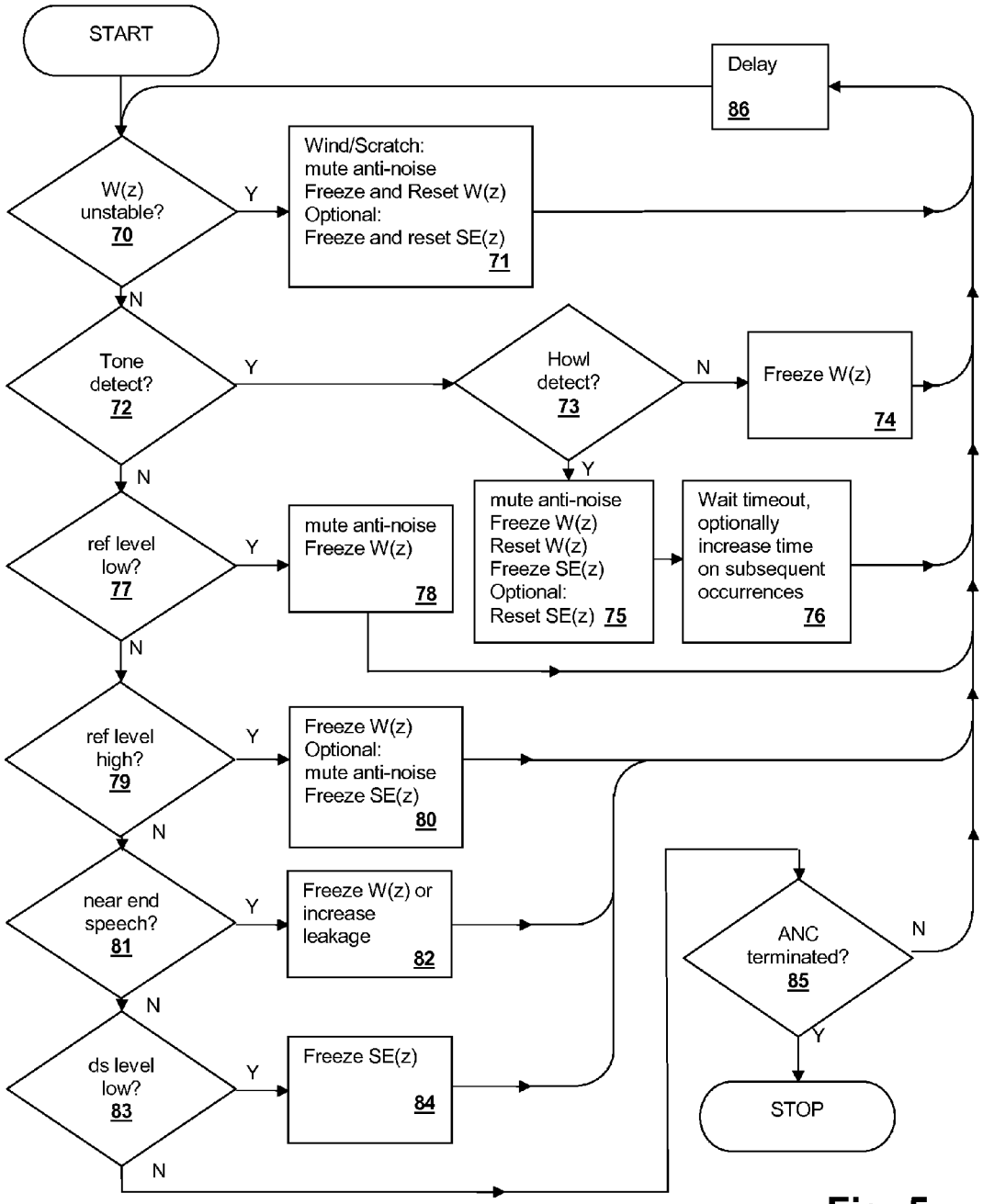
FIG. 5 is a flowchart of a method of determining that the ANC operation is likely to generate undesirable anti-noise or adapt improperly and taking appropriate action, in accordance with an embodiment of the present invention.

Referring now to FIG. 5, an oversight control algorithm is illustrated, in accordance with an embodiment of the present invention. If the adaptation of filter response W(z), i.e. the control of the values of the coefficients of filter response W(z), is determined to be unstable (decision 70), then the anti-noise is muted and filter response W(z) is reset and frozen from further adapting (step 71). Response SE(z) is optionally reset and frozen, as well. Alternatively, as mentioned above, rather than freezing adaptation of response W(z), the anti-noise signal can be re-directed into adaptive filter 34A. If a tone is detected (decision 72) and the positive feedback howling condition is indicated (decision 73), then the anti-noise is muted, responses W(z) and SE(z) are frozen from further adapting, response W(z) is reset and response SE(z) is optionally reset, as well (step 75). A wait time out is employed and may be increased for subsequent iterations (step 76). Otherwise, if a tone is detected (decision 72) and the howling condition is not indicated (decision 73), then response W(z) is frozen (step 74). If the reference microphone level is low (ref_low set) (decision 77), then anti-noise is muted and response W(z) is frozen from further adapting (step 78). If the reference microphone level is high (ref_hi set) (decision 79), then response W(z) is frozen from further adapting or the leakage of the adaptive filter is increased (step 78). Leakage in a parallel adaptive filter arrangement is described below with reference to FIG. 6. If the level of reference microphone channel ref is too high (ref_hi is set) (decision 79), then responses W(z) and SE(z) are frozen from further adapting and optionally, the anti-noise signal is muted (step 80). If near end speech is detected (ns_high is set) (decision 81), then response W(z) is either frozen from further adapting, or the leakage amount is increased (step 82). If the downlink audio ds level is low (ds_low is set), then response SE(z) is frozen from further adapting (step 84), since there is no downlink audio signal to which response SE(z) can train. Until the ANC processing is terminated (step 85), the process in steps 70-85 is repeated, with an additional delay 86 that permits the action to have time to react to, and in some cases stop, an undesirable condition that is detected by the algorithm illustrated in FIG. 5.

Figure 6:
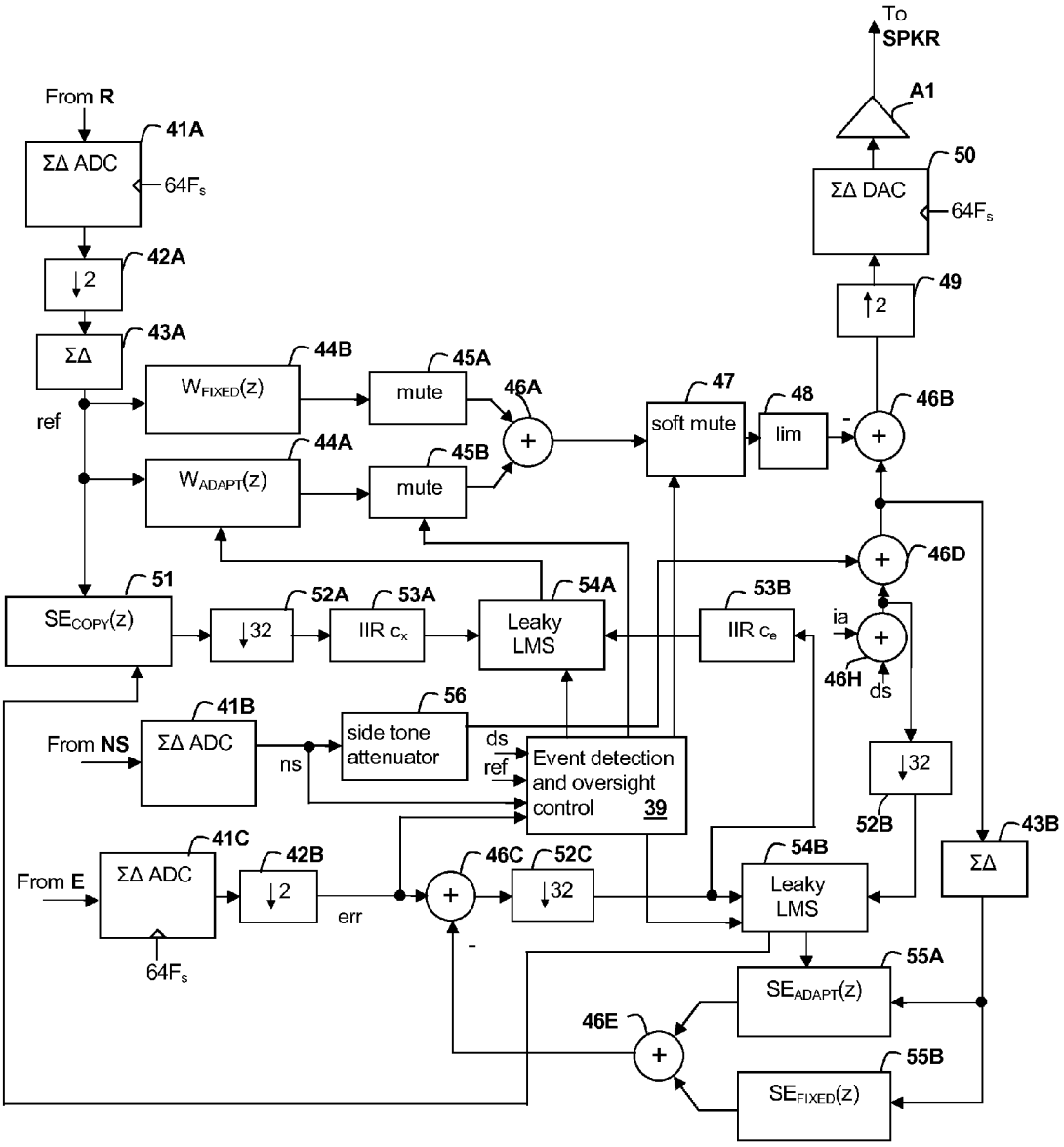
FIG. 6 is a block diagram depicting signal processing circuits and functional blocks within an integrated circuit in accordance with an embodiment of the present invention.

Referring now to FIG. 6, a block diagram of an ANC system is shown for illustrating ANC techniques in accordance with an embodiment of the invention, as may be implemented within CODEC integrated circuit 20. Reference microphone signal ref is generated by a delta-sigma ADC 41A that operates at 64 times oversampling and the output of which is decimated by a factor of two by a decimator 42A to yield a 32 times oversampled signal. A delta-sigma shaper 43A spreads the energy of images outside of bands in which a resultant response of a parallel pair of filter stages 44A and 44B will have significant response. Filter stage 44B has a fixed response $W_{FIXED}(z)$ that is generally predetermined to provide a starting point at the estimate of P(z)/S(z) for the particular design of wireless telephone 10 for a typical user. An adaptive portion $W_{ADAPT}(z)$ of the response of the estimate of P(z)/S(z) is provided by adaptive filter stage 44A, which is controlled by a leaky least-means-squared (LMS) coefficient controller 54A. Leaky LMS coefficient controller 54A is leaky in that the response normalizes to flat or otherwise predetermined response over time when no error input is provided to cause leaky LMS coefficient controller 54A to adapt. Providing a leaky controller prevents long-term instabilities that might arise under certain environmental conditions, and in general makes the system more robust against particular sensitivities of the ANC response. An exemplary leakage control equation is given by:

$$W_{k+1}=(1-\Gamma)\cdot W_k+\mu\cdot e_k\cdot X_k$$

where $\mu=2^{-normalzed_stepsize}$ and normalized_stepsize is a control value to control the step between each increment of k, $\Gamma=2^{-normalized_leakage}$, where normalized_leakage is a control value that determines the amount of leakage, $e_k$ is the magnitude of the error signal, $X_k$ is the magnitude of the reference microphone signal ref, $W_k$ is the starting magnitude of the amplitude response of filter 44A and $W_{k+1}$ is the updated value of the magnitude of the amplitude response of filter 44A. As mentioned above, increasing the leakage of LMS coefficient controller 54A can be performed when near-end speech is detected, so that the anti-noise signal is eventually generated from the fixed response, until the near-end speech has ended and the adaptive filter can again adapt to cancel the ambient environment at the listener's ear.

In the system depicted in FIG. 6, the reference microphone signal is filtered by a copy $SE_{copy}(z)$ of the estimate of the response of path S(z), by a filter 51 that has a response $SE_{copy}(z)$, the output of which is decimated by a factor of 32 by a decimator 52A to yield a baseband audio signal that is provided, through an infinite impulse response (IIR) filter 53A to leaky LMS 54A. Filter 51 is not an adaptive filter, per se, but has an adjustable response that is tuned to match the combined response of filters 55A and 55B, so that the response of filter 51 tracks the adapting of SE(z). The error microphone signal err is generated by a delta-sigma ADC 41C that operates at 64 times oversampling and the output of which is decimated by a factor of two by a decimator 42B to yield a 32 times oversampled signal. As in the system of FIG. 3, an amount of downlink audio ds that has been filtered by an adaptive filter to apply response S(z) is removed from error microphone signal err by a combiner 46C, the output of which is decimated by a factor of 32 by a decimator 52C to yield a baseband audio signal that is provided, through an infinite impulse response (IIR) filter 53B to leaky LMS 54A. Response S(z) is produced by another parallel set of filter stages 55A and 55B, one of which, filter stage 55B has fixed response $SE_{FIXED}(z)$, and the other of which, filter stage 55A has an adaptive response $SE_{ADAPT}(z)$ controlled by leaky LMS coefficient controller 54B. The outputs of filter stages 55A and 55B are combined by a combiner 46E. Similar to the implementation of filter response W(z) described above, response $SE_{FIXED}(z)$ is generally a predetermined response known to provide a suitable starting point under various operating conditions for electrical/acoustical path S(z). Filter 51 is a copy of adaptive filter 55A/55B, but is not itself an adaptive filter, i.e., filter 51 does not separately adapt in response to its own output, and filter 51 can be implemented using a single stage or a dual stage. A separate control value is provided in the system of FIG. 6 to control the response of filter 51, which is shown as a single adaptive filter stage. However, filter 51 could alternatively be implemented using two parallel stages and the same control value used to control adaptive filter stage 55A could then be used to control the adjustable filter portion in the implementation of filter 51. The inputs to leaky LMS control block 54B are also at baseband, provided by decimating a combination of downlink audio signal ds and internal audio ia, generated by a combiner 46H, by a decimator 52B that decimates by a factor of 32, and another input is provided by decimating the output of a combiner 46C that has removed the signal generated from the combined outputs of adaptive filter stage 55A and filter stage 55B that are combined by another combiner 46E. The output of combiner 46C represents error microphone signal err with the components due to downlink audio signal ds removed, which is provided to LMS control block 54B after decimation by decimator 52C. The other input to LMS control block 54B is the baseband signal produced by decimator 52B.

The above arrangement of baseband and oversampled signaling provides for simplified control and reduced power consumed in the adaptive control blocks, such as leaky LMS controllers 54A and 54B, while providing the tap flexibility afforded by implementing adaptive filter stages 44A-44B, 55A-55B and filter 51 at the oversampled rates. The remainder of the system of FIG. 6 includes combiner 46H that combines downlink audio ds with internal audio ia, the output of which is provided to the input of a combiner 46D that adds a portion of near-end microphone signal ns that has been generated by sigma-delta ADC 41B and filtered by a sidetone attenuator 56 to prevent feedback conditions. The output of combiner 46D is shaped by a sigma-delta shaper 43B that provides inputs to filter stages 55A and 55B that has been shaped to shift images outside of bands where filter stages 55A and 55B will have significant response.

In accordance with an embodiment of the invention, the output of combiner 46D is also combined with the output of adaptive filter stages 44A-44B that have been processed by a control chain that includes a corresponding hard mute block 45A, 45B for each of the filter stages, a combiner 46A that combines the outputs of hard mute blocks 45A, 45B, a soft mute 47 and then a soft limiter 48 to produce the anti-noise signal that is subtracted by a combiner 46B with the source audio output of combiner 46D. The output of combiner 46B is interpolated up by a factor of two by an interpolator 49 and then reproduced by a sigma-delta DAC 50 operated at the 64× oversampling rate. The output of DAC 50 is provided to amplifier A1, which generates the signal delivered to speaker SPKR.

Each or some of the elements in the system of FIG. 6, as well as in the exemplary circuits of FIG. 2 and FIG. 3, can be implemented directly in logic, or by a processor such as a digital signal processing (DSP) core executing program instructions that perform operations such as the adaptive filtering and LMS coefficient computations. While the DAC and ADC stages are generally implemented with dedicated mixed-signal circuits, the architecture of the ANC system of the present invention will generally lend itself to a hybrid approach in which logic may be, for example, used in the highly oversampled sections of the design, while program code or microcode-driven processing elements are chosen for the more complex, but lower rate operations such as computing the taps for the adaptive filters and/or responding to detected events such as those described herein.

While the invention has been particularly shown and described with reference to the preferred embodiments thereof, it will be understood by those skilled in the art that the foregoing and other changes in form, and details may be made therein without departing from the spirit and scope of the invention.

What is claimed is:

1. A personal audio device, comprising:

a personal audio device housing;

a transducer mounted on the housing for reproducing an audio signal including both source audio for playback to a listener and an anti-noise signal for countering the effects of ambient audio sounds in an acoustic output of the transducer;

a reference microphone mounted on the housing for providing a reference microphone signal indicative of the ambient audio sounds;

an error microphone mounted on the housing in proximity to the transducer for providing an error microphone signal indicative of the acoustic output of the transducer and the ambient audio sounds at the transducer; and a processing circuit that implements at least one adaptive filter having a response that generates the anti-noise signal from the reference signal to reduce the presence of the ambient audio sounds heard by the listener, wherein the processing circuit implements a coefficient control block that shapes the response of the at least one adaptive filter in conformity with the error microphone signal and the reference microphone signal by computing coefficients that determine the response of the adaptive filter to minimize the ambient audio sounds at the error microphone, and wherein the processing circuit detects that an ambient audio event is occurring that could cause the adaptive filter to generate an undesirable component in the anti-noise signal and changes the adapting of the at least one adaptive filter independent of the computing of the coefficients by the coefficient control block, wherein the ambient audio event is wind noise, scratching on the housing of the personal audio device, a substantially tonal ambient sound, or a signal level of the reference microphone signal falling outside of a predetermined range.

2. The personal audio device of claim 1, wherein the processing circuit changes the adaptation of the adaptive filter by halting the adaptation of the at least one of the adaptive filter.

3. The personal audio device of claim 1, wherein the processing circuit mutes the anti-noise signal during the ambient audio event.

4. The personal audio device of claim 1, wherein the processing circuit sets one or more coefficients of the at least one adaptive filter to a predetermined value to remedy disruption of the adapting of the response of the at least one adaptive filter by the ambient audio event.

5. The personal audio device of claim 1, wherein the ambient audio event is a level of the reference microphone signal falling outside of a predetermined range.

6. The personal audio device of claim 1, wherein the ambient audio event is substantially tonal.

7. The personal audio device of claim 1, wherein the ambient audio event is near-end speech.

8. A method of canceling ambient audio sounds in the proximity of a transducer of a personal audio device, the method comprising:

first measuring ambient audio sounds with a reference microphone to produce a reference microphone signal;

second measuring an output of the transducer and the ambient audio sounds at the transducer with an error microphone;

adaptively generating an anti-noise signal by computing coefficients that control a response of an adaptive filter from a result of the first measuring and the second measuring for countering the effects of ambient audio sounds at an acoustic output of the transducer by adapting the response of the adaptive filter, wherein the adaptive filter filters an output of the reference microphone to generate the anti-noise signal;

combining the anti-noise signal with a source audio signal to generate an audio signal provided to the transducer;

detecting that an ambient audio event is occurring that could cause the adaptive filter to generate an undesirable component in the anti-noise signal, wherein the ambient audio event is wind noise, scratching on a housing of the personal audio device, a substantially tonal ambient sound, or a signal level of the reference microphone signal falling outside of a predetermined range; and responsive to the detecting, changing the adapting of the at least one adaptive filter independent of the computing of the coefficients.

9. The method of claim 8, wherein the changing changes the adaptation of the adaptive filter by halting the adaptation of the at least one of the adaptive filter.

10. The method of claim 8, further comprising muting the anti-noise signal during the ambient audio event.

11. The method of claim 8, wherein the changing sets one or more coefficients of the at least one adaptive filter to a predetermined value to remedy disruption of the adapting of the response of the at least one adaptive filter by the ambient audio event.

12. The method of claim 8, wherein the ambient audio event is a level of the reference microphone signal falling outside of a predetermined range.

13. The method of claim 8, wherein the ambient audio event is substantially tonal.

14. The method of claim 8, wherein the ambient audio event is near-end speech.

15. An integrated circuit for implementing at least a portion of a personal audio device, comprising:

an output for providing a signal to a transducer including both source audio for playback to a listener and an anti-noise signal for countering the effects of ambient audio sounds in an acoustic output of the transducer;

a reference microphone input for receiving a reference microphone signal indicative of the ambient audio sounds;

an error microphone input for receiving an error microphone signal indicative of the output of the transducer and the ambient audio sounds at the transducer; and a processing circuit that implements at least one adaptive filter having a response that generates the anti-noise signal from the reference signal to reduce the presence of the ambient audio sounds heard by the listener, wherein the processing circuit implements a coefficient control block that shapes the response of the at least one adaptive filter in conformity with the error microphone signal and the reference microphone signal by computing coefficients that determine the response of the adaptive filter to minimize the ambient audio sounds at the error microphone, and wherein the processing circuit detects that an ambient audio event is occurring that could cause the adaptive filter to generate an undesirable component in the anti-noise signal and changes the adapting of the at least one adaptive filter independent of the computing of the coefficients by the coefficient control block, wherein the ambient audio event is wind noise, scratching on a housing of the personal audio device, a substantially tonal ambient sound, or a signal level of the reference microphone signal falling outside of a predetermined range.

16. The integrated circuit of claim 15, wherein the processing circuit changes the adaptation of the adaptive filter by halting the adaptation of the at least one of the adaptive filter.

17. The integrated circuit of claim 15, wherein the processing circuit mutes the anti-noise signal during the ambient audio event.

18. The integrated circuit of claim 15, wherein the processing circuit sets one or more coefficients of the at least one adaptive filter to a predetermined value to remedy disruption of the adapting of the response of the at least one adaptive filter by the ambient audio event.

19. The integrated circuit of claim 15, wherein the ambient audio event is a level of the reference microphone signal falling outside of a predetermined range.

20. The integrated circuit of claim 15, wherein the ambient audio event is substantially tonal.

21. The integrated circuit of claim 15, wherein the ambient audio event is near-end speech.

* * * * *